US008884594B2

(12) United States Patent
Sugiura

(10) Patent No.: US 8,884,594 B2
(45) Date of Patent: Nov. 11, 2014

(54) VOLTAGE REGULATOR

(75) Inventor: Masakazu Sugiura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 381 days.

(21) Appl. No.: 13/372,007

(22) Filed: Feb. 13, 2012

(65) Prior Publication Data

US 2012/0206119 A1 Aug. 16, 2012

(30) Foreign Application Priority Data

Feb. 16, 2011 (JP) ..... 2011-031297

(51) Int. Cl.
*G05F 1/56* (2006.01)

(52) U.S. Cl.
CPC ..... *G05F 1/56* (2013.01)
USPC ..... 323/280; 323/281

(58) Field of Classification Search
USPC ..... 323/224–226, 288.299, 312–315, 323/284–288; 361/18, 55–56, 91.6, 91.1, 361/90, 93.9
See application file for complete search history.

(56) References Cited

U.S. PATENT DOCUMENTS

| | | | | |
|---|---|---|---|---|
| 4,438,347 | A * | 3/1984 | Gehring | 327/511 |
| 4,731,574 | A * | 3/1988 | Melbert | 323/275 |
| 6,618,406 | B1 * | 9/2003 | Kaminishi | 372/38.02 |
| 7,224,155 | B2 * | 5/2007 | Bo et al. | 323/312 |
| 7,405,547 | B2 * | 7/2008 | Kanzaki | 323/277 |

FOREIGN PATENT DOCUMENTS

| | | |
|---|---|---|
| JP | 04-195613 | 7/1992 |

* cited by examiner

*Primary Examiner* — Rajnikant Patel
(74) *Attorney, Agent, or Firm* — Brinks Gilson & Lione

(57) ABSTRACT

Provided is a voltage regulator having improved overshoot characteristics. In the voltage regulator, a current limiting circuit formed of, for example, a constant current source is provided in series to an output transistor, to thereby limit an output overcurrent. Further, a voltage limiting circuit formed of, for example, a diode is provided to an output terminal, to thereby limit an output voltage.

9 Claims, 11 Drawing Sheets

VOLTAGE REGULATOR

RELATED APPLICATIONS

This application claims priority under 35 U.S.C. §119 to Japanese Patent Application No. 2011-031297 filed on Feb. 16, 2011, the entire content of which is hereby incorporated by reference.

BACKGROUND OF THE INVENTION

1. Field of the Invention

The present invention relates to an improvement in overshoot characteristics of a voltage regulator.

2. Description of the Related Art

A conventional voltage regulator includes, as illustrated in a block diagram of FIG. 11, a reference voltage circuit 1101, voltage dividing resistors 1103 and 1104, an error amplifier 1105, and an output transistor 1106.

The reference voltage circuit 1101 outputs a reference voltage VREF. The voltage dividing resistors 1103 and 1104 output a divided voltage VA by dividing an output voltage VOUT at an output terminal 1102 of the voltage regulator. The error amplifier 1105 amplifies a difference voltage between the reference voltage VREF and the divided voltage VA, and controls a gate of the output transistor 1106 by an output voltage VERR thereof. The output transistor 1106 maintains the output voltage VOUT at the output terminal 1102 constant based on a power supply voltage VDD of a voltage source 1107 and the output voltage VERR. The voltage regulator operates with the power supply voltage VDD.

The voltage regulator operates as follows to maintain the output voltage VOUT constant (see, for example, Japanese Patent Application Laid-open No. Hei 4-195613 (pages 1-3, FIG. 2).

When the output voltage VOUT decreases, the output voltage VERR of the error amplifier 1105 decreases to increase a gate-source voltage of the output transistor 1106. Accordingly, an ON-state resistance of the output transistor 1106 decreases to increase the output voltage VOUT. When the output voltage VOUT increases, the output voltage VERR of the error amplifier 1105 increases to decrease the gate-source voltage of the output transistor 1106. Accordingly, the ON-state resistance of the output transistor 1106 increases to decrease the output voltage VOUT.

The conventional voltage regulator, however, has a problem in that an overshoot occurs in the output voltage VOUT when the power supply voltage VDD changes in a pulse manner in situations such as power on and power supply fluctuations or when a load connected to the output terminal 1102 of the voltage regulator abruptly changes.

SUMMARY OF THE INVENTION

The present invention has been made for solving the above-mentioned problem, and realizes a voltage regulator having improved overshoot characteristics.

A voltage regulator according to the present invention includes: a reference voltage circuit; an output terminal for outputting an output voltage based on a reference voltage of the reference voltage circuit; a voltage dividing circuit for dividing the output voltage; an output transistor; an error amplifier for outputting a control signal of the output transistor based on an output of the voltage dividing circuit and the reference voltage; a voltage limiting circuit; and a current limiting circuit.

The voltage regulator of the present invention can be operated without causing an excessive overshoot in the output voltage. Thus, the voltage regulator having improved overshoot characteristics can be provided.

DETAILED DESCRIPTION OF THE PREFERRED EMBODIMENTS

Figure 1:
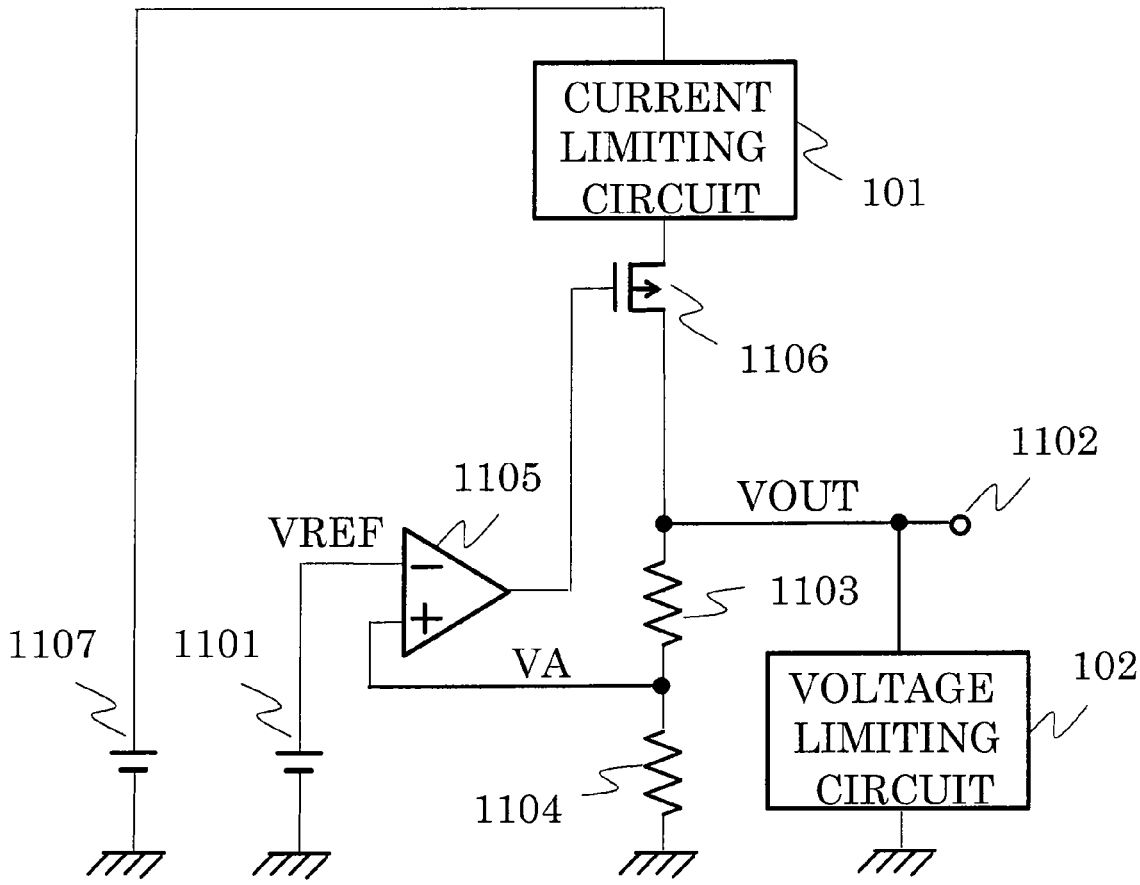
FIG. 1 is a block diagram illustrating a voltage regulator according to an embodiment of the present invention.

FIG. 1 is a block diagram illustrating a voltage regulator according to an embodiment of the present invention.

The voltage regulator of this embodiment includes a reference voltage circuit 1101, voltage dividing resistors 1103 and 1104, an error amplifier 1105, an output transistor 1106, a current limiting circuit 101, and a voltage limiting circuit 102.

The current limiting circuit 101 is provided between a voltage source 1107 and the output transistor 1106. The voltage limiting circuit 102 is provided between an output terminal 1102 and a ground terminal.

Figure 2:
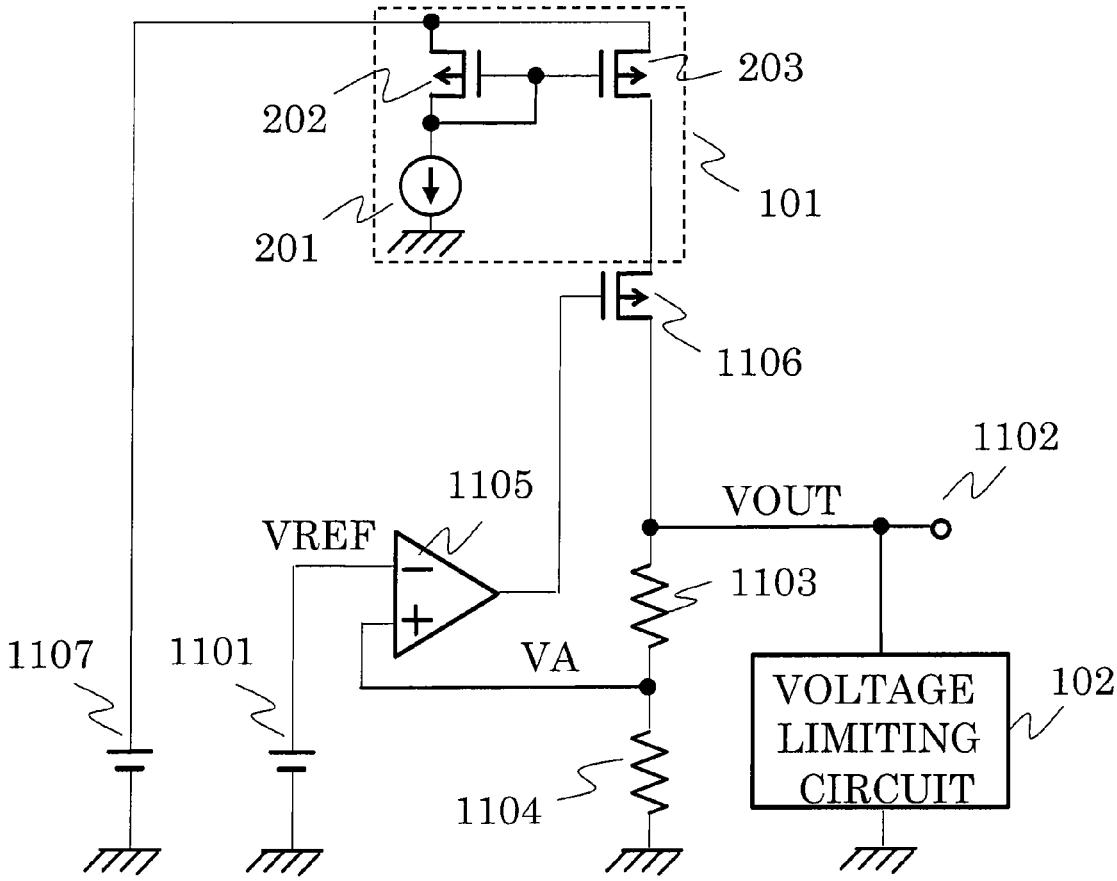
FIG. 2 is a block diagram illustrating an example of a current limiting circuit of the voltage regulator according to the embodiment of the present invention.
Figure 3:
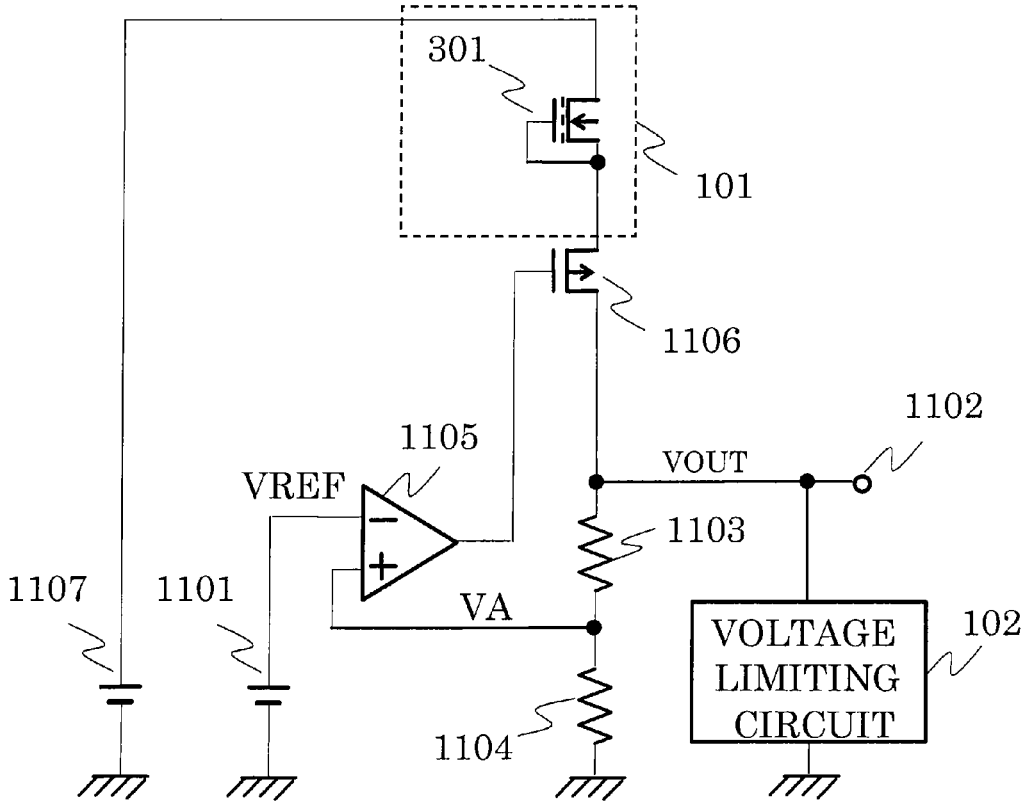
FIG. 3 is a block diagram illustrating another example of the current limiting circuit of the voltage regulator according to the embodiment of the present invention.
Figure 4:
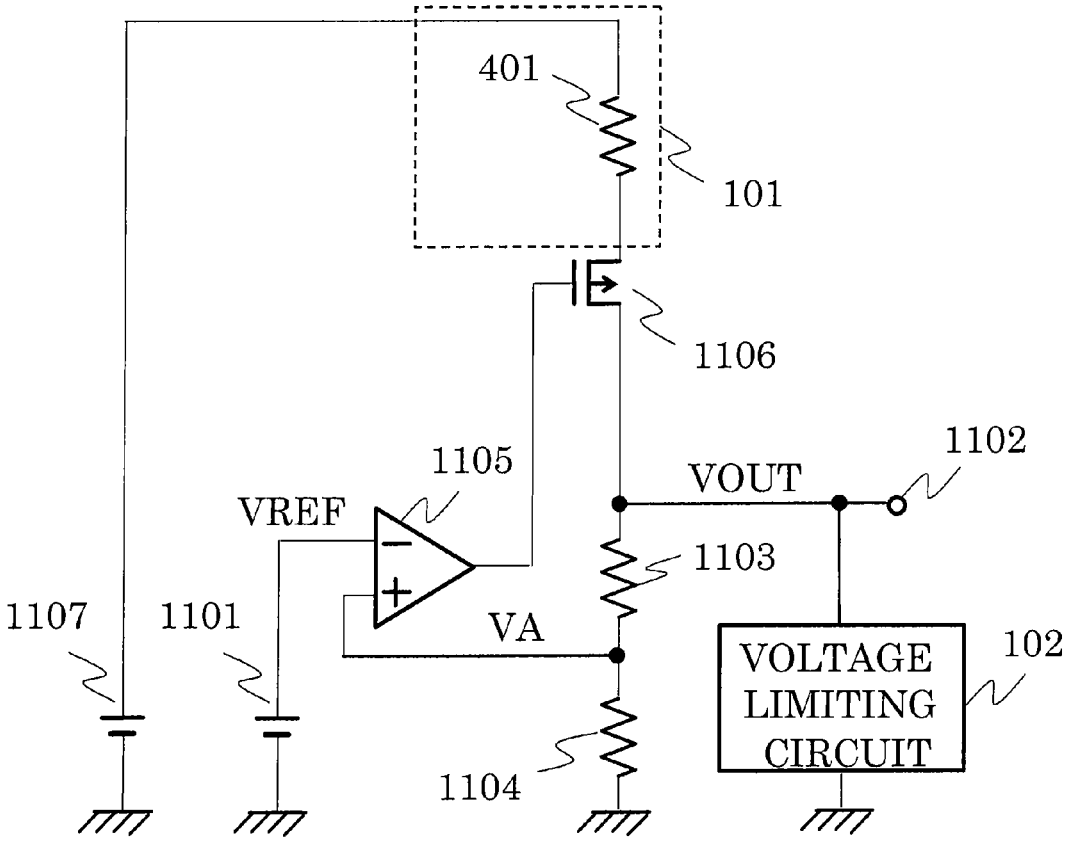
FIG. 4 is a block diagram illustrating still another example of the current limiting circuit of the voltage regulator according to the embodiment of the present invention.

The current limiting circuit 101 has a function of limiting a maximum value of a current supplied by the output transistor 1106. The current limiting circuit 101 is formed of, for example, a circuit illustrated in FIG. 2 including a constant current source 201 and a current mirror circuit of transistors 202 and 203, a depletion mode transistor 301 illustrated in FIG. 3, or a resistor 401 illustrated in FIG. 4.

Figure 5:
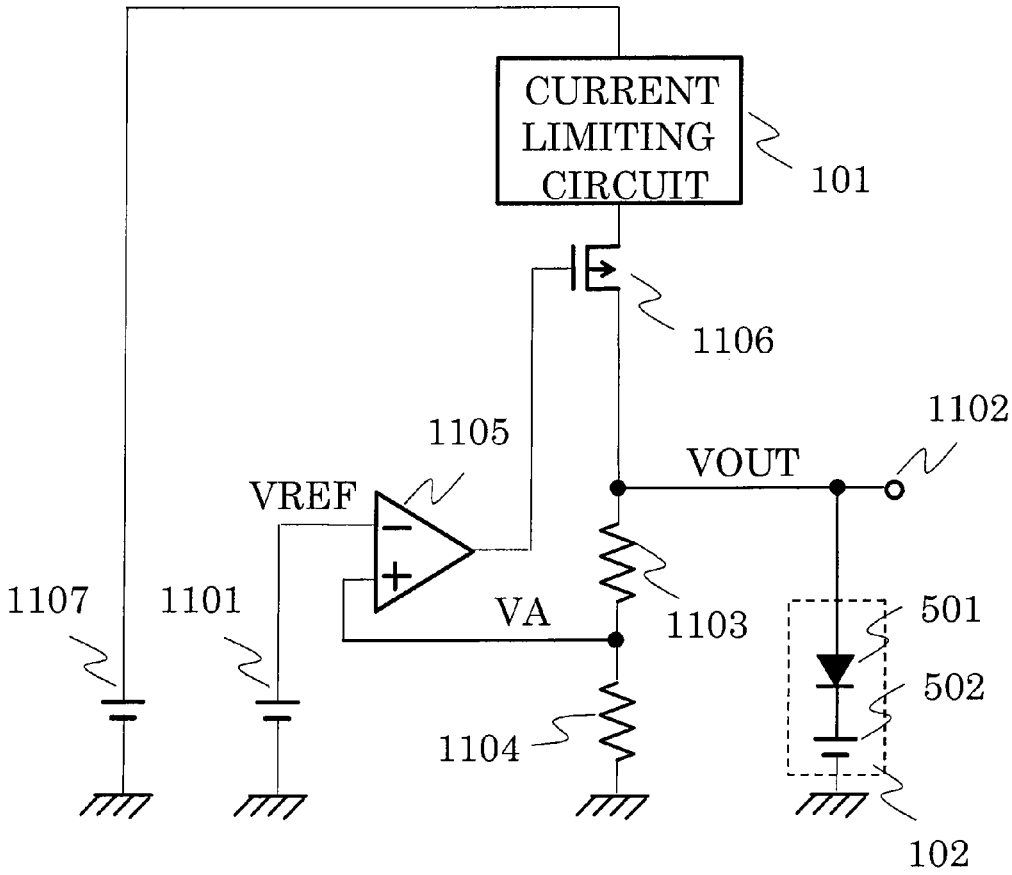
FIG. 5 is a block diagram illustrating an example of a voltage limiting circuit of the voltage regulator according to the embodiment of the present invention.
Figure 6:
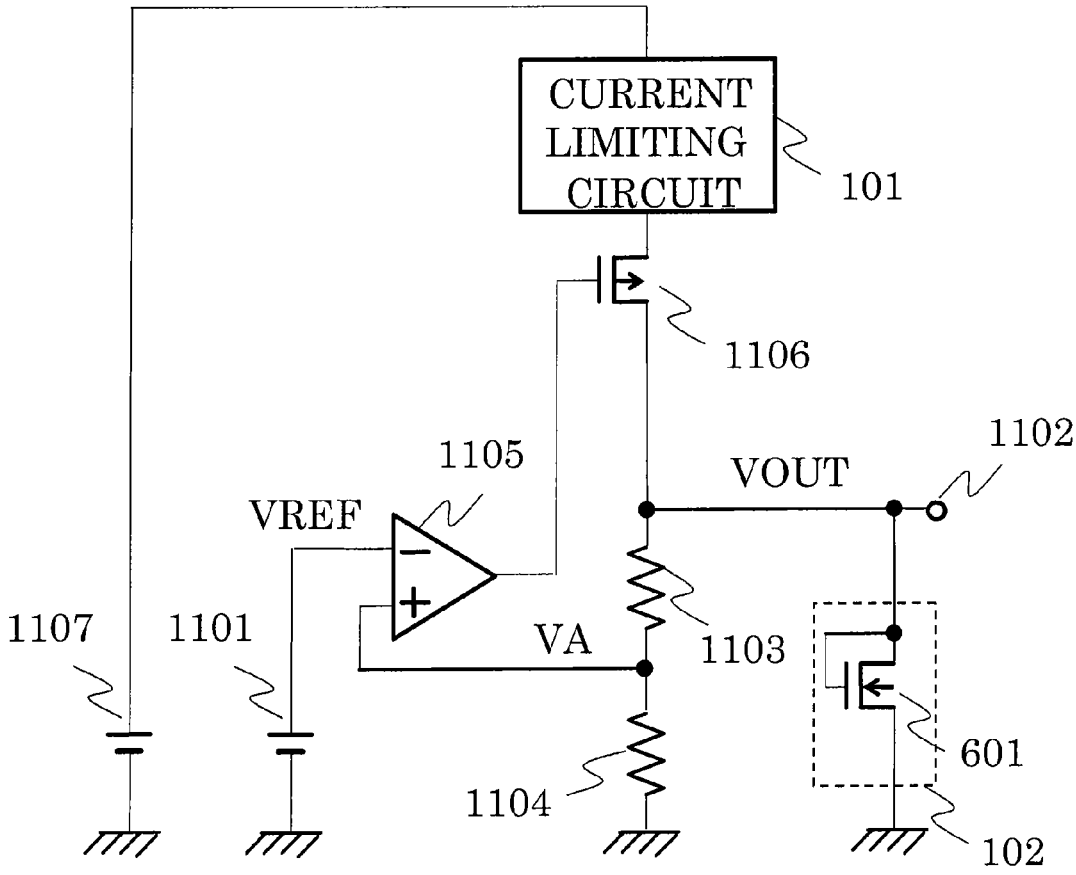
FIG. 6 is a block diagram illustrating another example of the voltage limiting circuit of the voltage regulator according to the embodiment of the present invention.

The impedance of the voltage limiting circuit 102 decreases as an output voltage VOUT becomes higher than a desired voltage. The voltage limiting circuit 102 is formed of, for example, a diode 501 and a reference voltage circuit 502 (the reference voltage circuit 502 may be a diode) as illustrated in FIG. 5 or a saturation-connected transistor 601 as illustrated in FIG. 6.

Hereinafter, an operation of the voltage regulator of this embodiment is described.

The output voltage VOUT decreases due to a voltage coupling effect when the power supply voltage VDD is changed in a pulse manner at the time of power on or power supply fluctuations or when a load connected to the output terminal 1102 of the voltage regulator abruptly changes to exceed the current supply performance of the output transistor 1106 with respect to the load. A divided voltage VA obtained by dividing the output voltage VOUT also decreases, and hence an output voltage VERR of the error amplifier 1105 decreases. Therefore, the output transistor 1106 attempts to cause an instantaneous large current to flow because the ON-state resistance thereof is reduced.

On this occasion, a drive current of the output transistor 1106 is limited by the current limiting circuit 101 provided between the output transistor 1106 and the voltage source 1107. For example, the current limiting circuit 101 of FIG. 2 limits a current supplied by a current source 201.

Further, when the drive current of the output transistor 1106 increases, the output voltage VOUT also increases. On this occasion, the output voltage VOUT is limited by the voltage limiting circuit 102 provided to the output terminal 1102. For example, the voltage limiting circuit 102 of FIG. 5 decreases the impedance by a forward biased diode 501 connected between the output terminal 1102 and the ground terminal when the voltage at the output terminal 1102 increases. Further, the drive current of the output transistor 1106 is limited also by the diode 501, and hence the voltage regulator can be operated without causing an excessive overshoot in the output voltage VOUT.

Therefore, the voltage regulator of this embodiment can be operated without causing an excessive overshoot in the output voltage. Thus, the voltage regulator having improved overshoot characteristics can be provided.

In the voltage regulator of this embodiment described above, the output voltage VOUT is divided by the voltage dividing resistors 1103 and 1104. However, the same effect can be obtained even when the resistance values of the voltage dividing resistors 1103 and 1104 are set to zero or excessive values as long as a desired voltage division ratio can be obtained.

Figure 7:
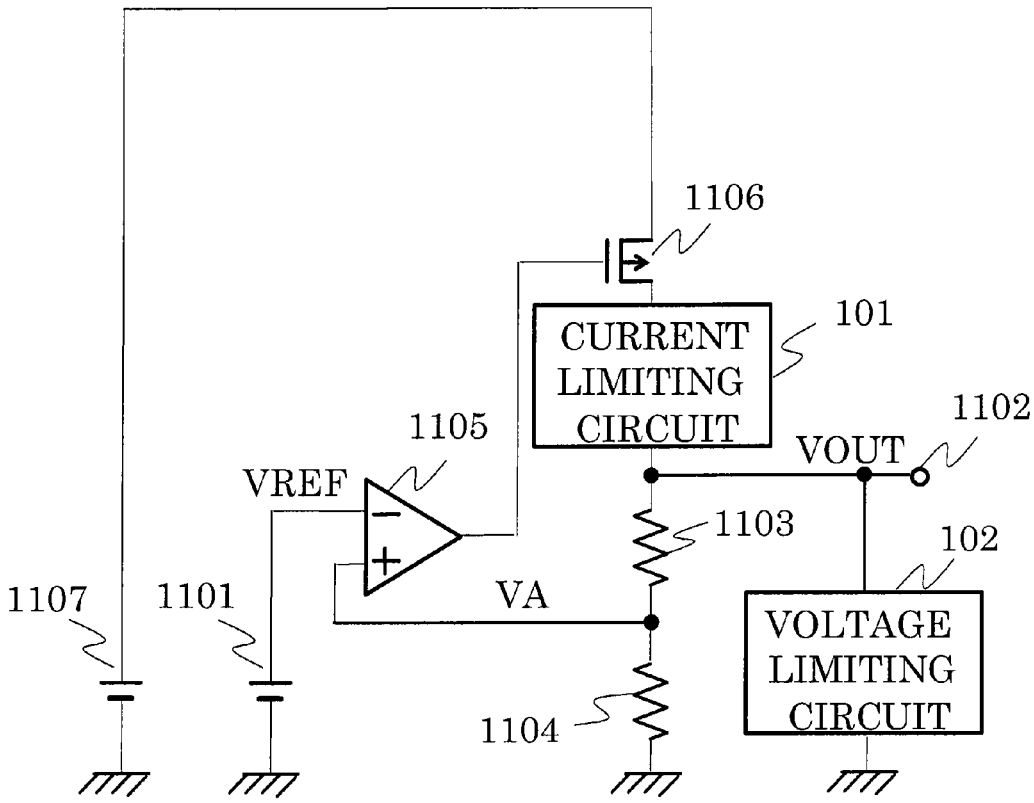
FIG. 7 is a block diagram illustrating a voltage regulator according to another embodiment of the present invention.
Figure 8:
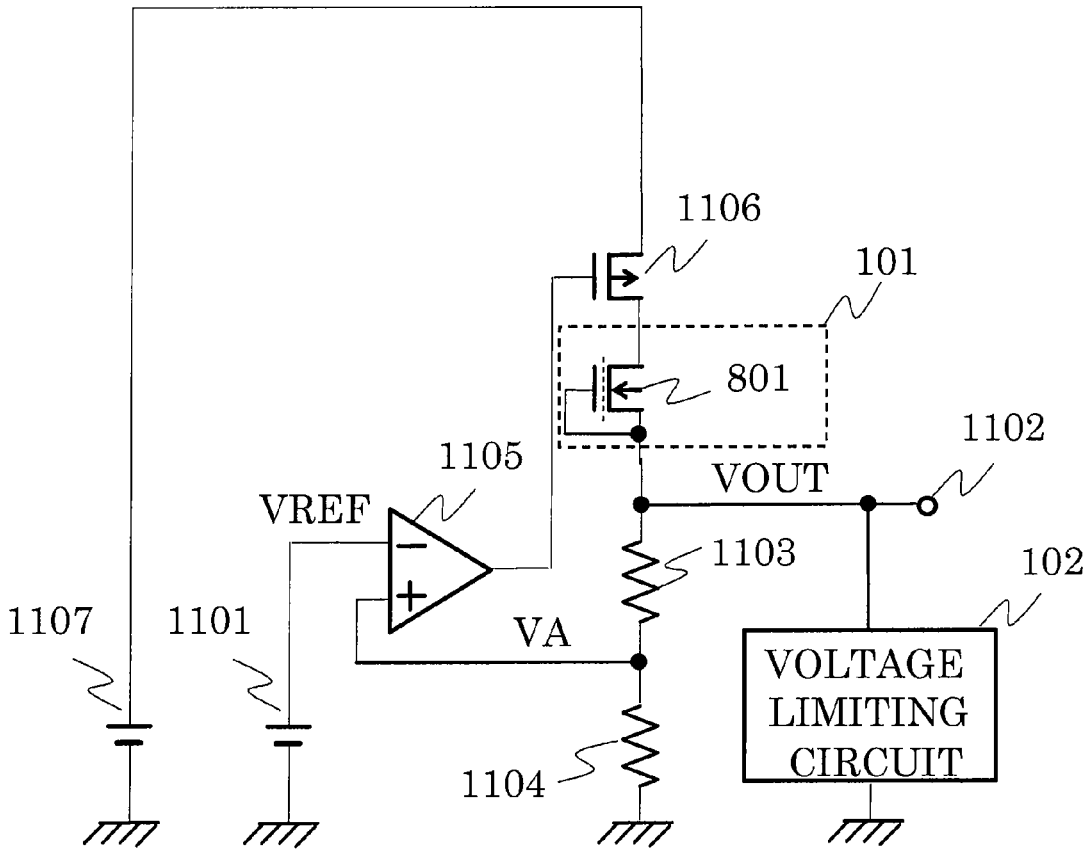
FIG. 8 is a block diagram illustrating a voltage regulator according to still another embodiment of the present invention.

In the voltage regulator of this embodiment described above, the current limiting circuit 101 is provided on the High side of the output transistor 1106. However, the same effect can be obtained even when the current limiting circuit 101 is provided on the Low side of the output transistor 1106 as illustrated in FIGS. 7 and 8. FIG. 8 illustrates an example in which the current limiting circuit 101 is formed of a depletion mode transistor 801. In FIG. 8, as the output voltage VOUT becomes higher, a threshold voltage of the depletion mode transistor 801 becomes higher because a back gate voltage thereof drops, and hence the voltage regulator operates so as to limit the current more. Thus, there is another advantage that, when the voltage regulator operates stably, the drive current of the output transistor 1106 can be increased, and, only when the output voltage VOUT increases, the current can be limited more.

In the voltage regulator of this embodiment described above, the current limiting circuit 101 has the configuration illustrated in FIG. 2, 3, 4, or 8. However, the same effect can be obtained also by other configurations capable of providing the same function.

In the voltage regulator of this embodiment described above, the voltage limiting circuit 102 has the configuration illustrated in FIG. 5 or 6. However, the diode or the transistor forming the voltage limiting circuit 102 may be connected in series to the output voltage VOUT as appropriate. The same effect can be obtained also by other configurations capable of providing the same function. For example, instead of the diode, a diode-connected transistor may be provided.

Figure 9:
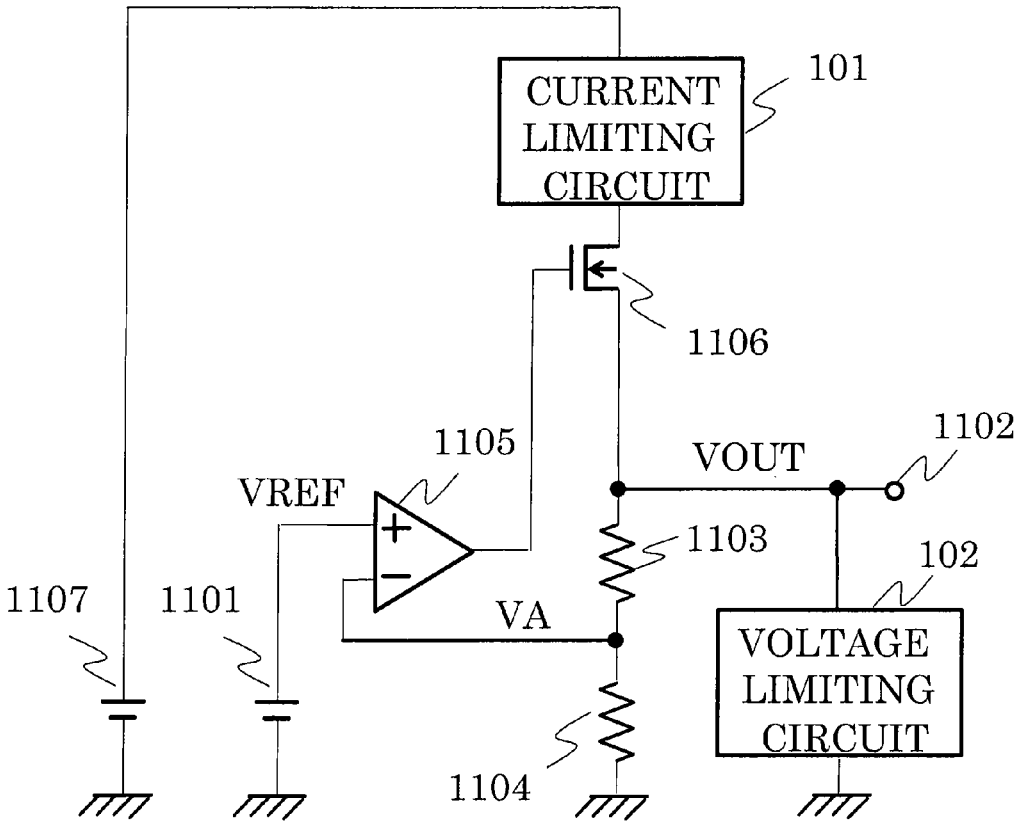
FIG. 9 is a block diagram illustrating a voltage regulator according to yet another embodiment of the present invention.
Figure 10:
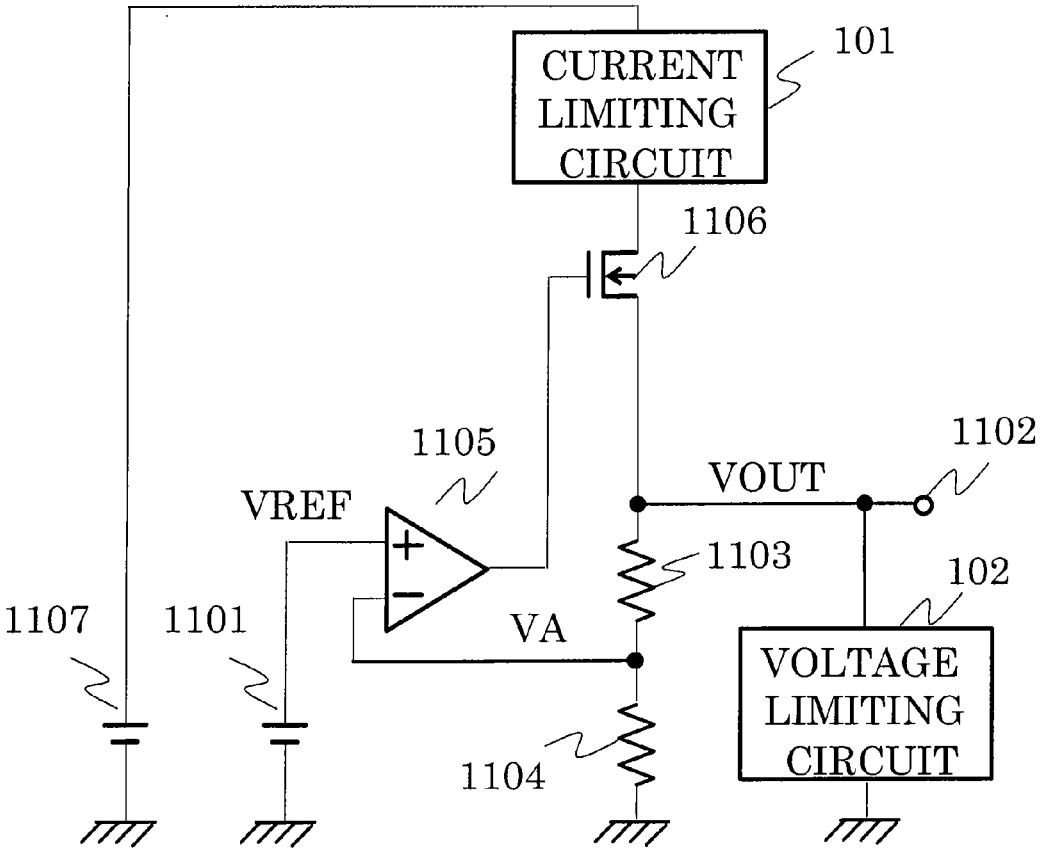
FIG. 10 is a block diagram illustrating a voltage regulator according to a further embodiment of the present invention.
Figure 11:
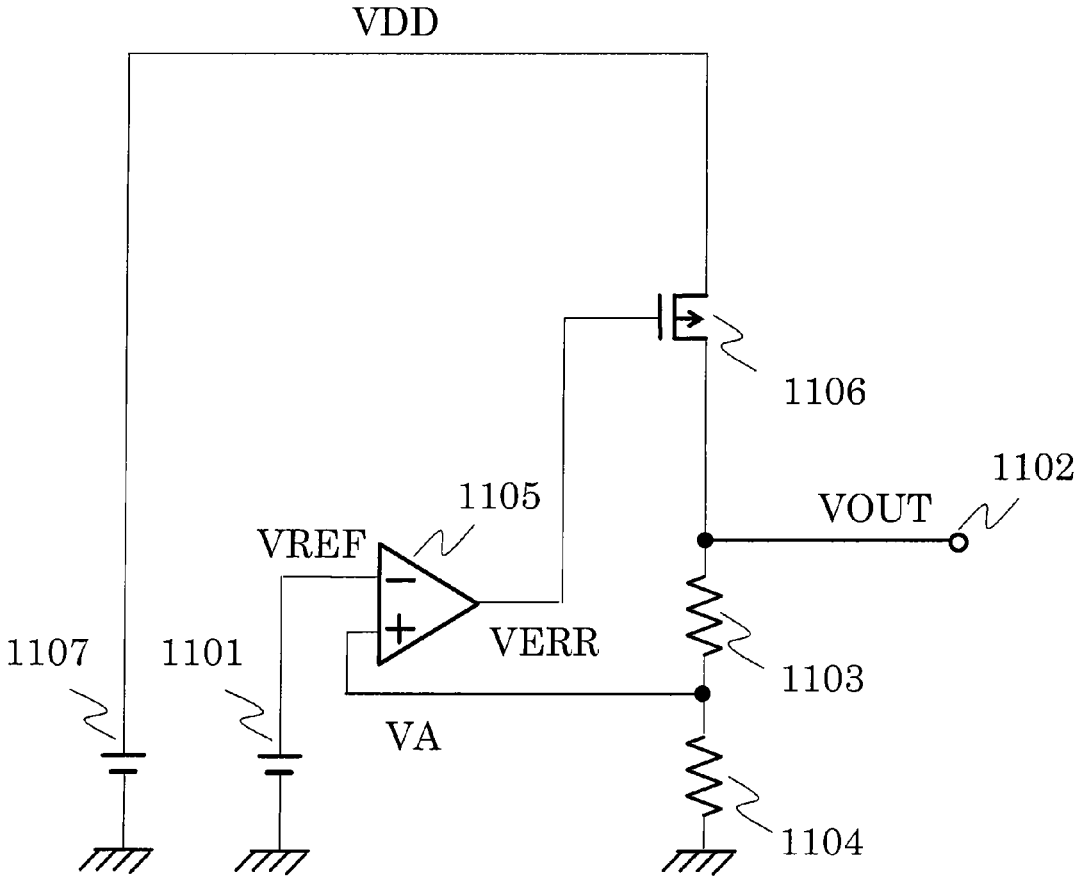
FIG. 11 PRIOR ART
FIG. 11 is a block diagram of a conventional voltage regulator.

In the voltage regulator of this embodiment described above, the output transistor is a P-type transistor. However, the same effect can be obtained even with an N-type transistor. FIGS. 9 and 10 are examples of block diagrams in this case. The type of the output transistor is not limited, and either an enhancement mode transistor or a depletion mode transistor may be employed.

What is claimed is:

1. A voltage regulator, comprising:

an error amplifier circuit for amplifying and outputting a difference between a divided voltage obtained by dividing a voltage output from a first terminal of an output transistor and a reference voltage, to thereby control a gate of the output transistor; and a current limiting circuit including a current limiting component directly connected in series to a second terminal of the output transistor, for limiting an output current of the output transistor, the first terminal of the output transistor connected to an output terminal.

2. A voltage regulator according to claim 1, further comprising a voltage limiting circuit connected to the output terminal, for limiting the output voltage of the output transistor.

3. A voltage regulator according to claim 1, wherein the current limiting component of the current limiting circuit comprises a current mirror circuit, and the current limiting circuit further comprises a constant current source connected to the current mirror circuit.

4. A voltage regulator according to claim 2, wherein current limiting component of the current limiting circuit comprises a current mirror circuit, and the current limiting circuit further comprises a constant current source connected to the current mirror circuit.

5. A voltage regulator according to claim 2, wherein the voltage limiting circuit comprises at least one diode element.

6. A voltage regulator according to claim 3, further comprising a voltage limiting circuit connected to the output terminal, wherein the voltage limiting circuit comprises at least one diode element.

7. A voltage regulator according to claim 4, wherein the voltage limiting circuit comprises at least one diode element.

8. A voltage regulator according to claim 1, wherein the current limiting component the current limiting circuit comprises a depletion transistor.

9. A voltage regulator according to claim 1, wherein the current limiting component the current limiting circuit comprises a resistor.

* * * * *